US005787551A

United States Patent [19]

Drennan

[11] Patent Number: 5,787,551

[45] Date of Patent: Aug. 4, 1998

[54] STORAGE HOPPER FOR INCLINED CLEANER

[75] Inventor: Randal R. Drennan, Lubbock, Tex.

[73] Assignee: Cotton Machinery, Inc., Lubbock, Tex.

[21] Appl. No.: 827,803

[22] Filed: Apr. 11, 1997

Related U.S. Application Data

[60] Provisional application No. 60/016,580, Apr. 30, 1996.

[51] Int. Cl.[6] ..... D01B 1/06

[52] U.S. Cl. ..... 19/39; 19/40; 19/48 R

[58] Field of Search ..... 19/39, 40, 41, 19/64.5, 48 R

[56] References Cited

U.S. PATENT DOCUMENTS

| | | | |
|---|---|---|---|
| 1,458,870 | 6/1923 | Zoeller | 19/64.5 |
| 1,918,610 | 7/1933 | Mitchell | 19/48 R |
| 2,129,630 | 9/1938 | Streun | 19/64.5 |
| 3,963,111 | 6/1976 | Harrell et al. | 19/64.5 |
| 4,890,357 | 1/1990 | Pinto et al. | 19/64.5 |
| 5,016,320 | 5/1991 | Vandergriff | 19/40 |
| 5,392,495 | 2/1995 | Horn | 19/64.5 |

*Primary Examiner*—Michael A. Neas
*Attorney, Agent, or Firm*—Wendell Coffee

[57] ABSTRACT

A storage hopper is placed upstream of an inclined cleaner to prevent a surge of cotton from choking down the inclined cleaner. The output of the storage hopper is limited by feed rollers.

9 Claims, 1 Drawing Sheet

STORAGE HOPPER FOR INCLINED CLEANER

CROSS REFERENCE TO RELATED APPLICATION

Provisional Patent Application

Applicant filed a Provisional Application on this subject matter on Apr. 30, 1996, 60/016,580. Specific reference is made to that document.

BACKGROUND OF THE INVENTION (1). Field of the Invention

This invention relates to cotton gins with a module feed.

(2). Description of the Related Art

A problem exists in cotton gins being fed from a module feeder. The problem is in the interaction of the module feeder and an inclined cleaner. The inclined cleaner is one of the first pieces of machinery to which the seed cotton is fed from a module feeder. The seed cotton may go through a cotton dryer, but this is not considered to be a piece of machinery because the cotton is carried in an air stream. The inclined cleaner is the first piece of machinery where the cotton is engaged by structure which will choke down if overfed. The module feeder inherently feeds cotton at an irregular rate.

In modern cotton gins, cotton will be fed into the inclined cleaner at a rate of about 1,000 lbs. per minute. The inclined cleaner operates at very close to its absolute capacity. If cotton is fed to the inclined cleaner at a rate faster than its capacity, the cotton builds up quicker than the picker rollers can move it over the grids. The cotton chokes up the grid, rotation slows down, additional cotton is fed that moves through the cleaner at a slower rate till the full choke up results. The rollers of the inclined feeder stops and the cotton continues to flow into it until it cuts off the suction.

SUMMARY OF THE INVENTION

This invention solves the problem by providing a storage hopper between the module feeder and the inclined cleaner. The storage hopper is set to disperse cotton at slightly lower rate than the absolute capacity of the cleaner. Therefore, if a surge of cotton from the module feeder enters the gin, the surge is held in the storage hopper for a short period of time until the surge is over. The cotton is fed regularly into the inclined cleaner. It is anticipated that the capacity of the storage hopper might well be no more than the amount of cotton to feed in one (1) minute, i.e. 1000 lbs.

OBJECTS OF THIS INVENTION

An object of this invention is to prevent surges of cotton from choking down the inclined cleaner of a cotton gin.

Further objects are to achieve the above with devices that are sturdy, compact, durable, lightweight, simple, safe, efficient, versatile, ecologically compatible, energy conserving, and reliable, yet inexpensive and easy to manufacture, install, operate, and maintain.

Other objects are to achieve the above with a method that is rapid, versatile, ecologically compatible, energy conserving, efficient, and inexpensive, and does not require highly skilled people to install, operate, and maintain.

The specific nature of the invention, as well as other objects, uses, and advantages thereof, will clearly appear from the following description and from the accompanying drawings, different views of which are not necessarily scale drawings.

CATALOGUE OF ELEMENTS

Figure 1:
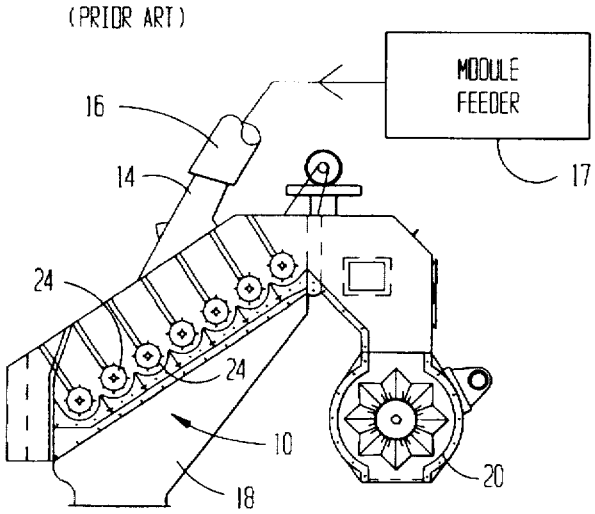
FIG. 1 is a side sectional view of a prior art inclined cleaner.
Figure 3:
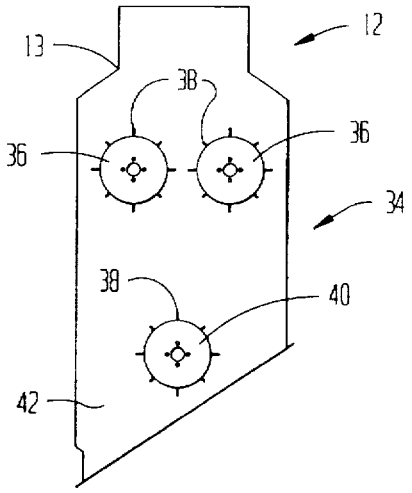
FIG. 3 is a sectional view of the dispersing unit.
Figure 2:
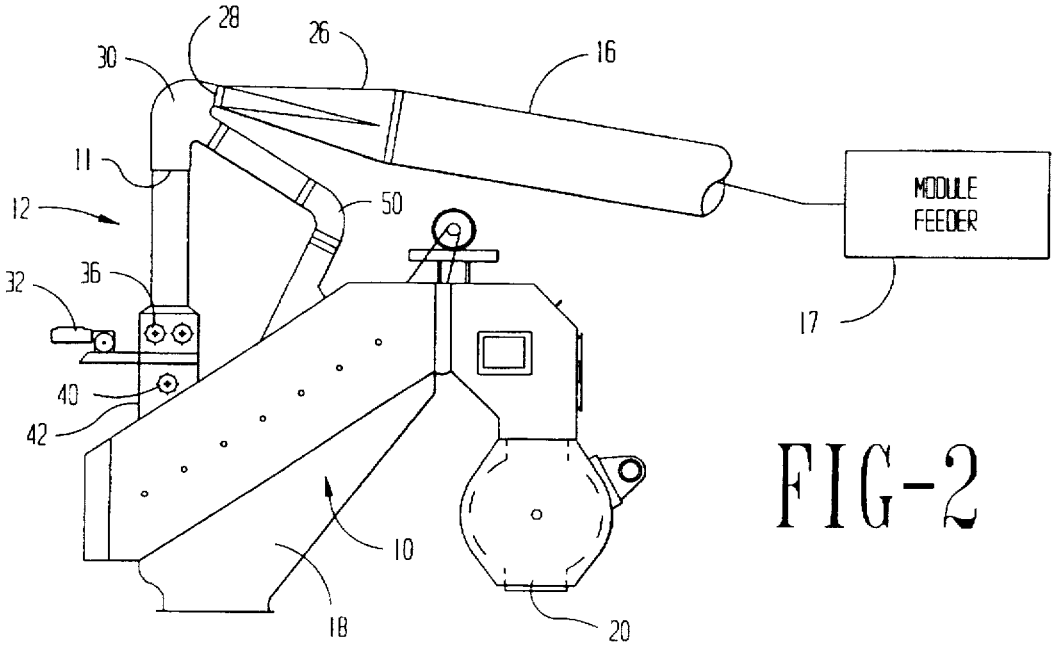
FIG. 2 is a side elevational schematic view of an embodiment of this invention.

As an aid to correlating the terms to the exemplary drawing(s), the following catalog of elements is provided:

10 inclined cleaner
11 top
12 storage hopper or chamber
13 bottom
14 normal entry
16 suction pipe
17 module feeder
18 trash outlet
20 vacuum dropper
24 rollers
26 suction transit
28 down stream
30 elbow
32 variable speed mtr.
34 dispersing unit
36 feed rollers
38 dispersing spikes
40 wad buster
42 outlet transfer means
50 by-pass conduit

DESCRIPTION OF THE PREFERRED EMBODIMENT

Referring to the drawings there may be seen an inclined cleaner 10. The cleaner, except for having an additional opening for chamber or storage hopper 12 is according to the prior art. It will have a normal entry 14 which before this invention was where all of the seed cotton and air was fed into the cleaner. The cotton and air was furnished to the cleaner by a extension of the suction pipe 16. This is referred to as an extension of the suction pipe 16, although actually it may be a pipe extending from a dryer. Stated otherwise the pipe 16 is a inlet transfer means for transferring seed cotton from a feed means for feeding seed cotton into the cotton gin. The feed means is represented in the drawings by module feeder 17.

The inclined cleaner will have a trash and air outlet 18 at the bottom as is conventional. The cotton from the inclined cleaner will be discharged from the vacuum dropper 20 into a conveyor as is conventional. An electric motor (not shown) will power the rollers 24 within the inclined cleaner.

Those in the skill of the ordinary art will understand that basically the equipment that is described to this point is conventional and well known except for the additional opening for the hopper.

According to this invention, transition 26 from the suction pipe 16 is located between the suction pipe 16 and the storage hopper 12 so that the inlet feed width is increased to the full width of the storage hopper 12 which is the width of the inclined cleaner 20. Elbow 30 extends from down stream end 28 of the transition 26.

In normal operation, most of the air and all of the seed cotton will flow through the elbow into the hopper 12. Feed rollers 36 are at the bottom of the hopper. The feed rollers are driven by variable speed motor 32. Wad buster cylinder 40 is located below the feed rollers. The wad buster cylinder will also be driven by the variable speed motor 32.

In operation if there is no sudden surge or slug of seed cotton fed, the cotton and air will flow through the hopper 12, through feed rollers and the wad buster cylinder into the inclined feeder. Experience has shown that the cotton drops into the inclined feeder at approximately the same location as if it were fed through the conventional opening 14 because of the angle of the conventional opening 14.

However, when a surge of seed cotton is fed, it will flow into the hopper faster than the variable speed feed rollers discharge it into the inclined feeder. Therefore, the hopper will fill partially with seed cotton. In as much as the air flow will not flow through the seed cotton readily, the air flow will be diverted back into by-pass conduit 50, which is connected from the inside of the elbow into the normal inlet 14 of the inclined feeder. When there is a slug of cotton in the hopper 12, the elbow 30 functions as an inertia separator. That is to say that the seed cotton because of its weight will be carried by inertia into the path that leads it into the hopper 12. However the air will be separated from the cotton and the air will go into the by-pass conduit 50.

In operation the feed rollers are set to feed the cotton as close to the maximum capacity of the inclined cleaner as possible without providing such a heavy feed that it causes the rollers to rotate at a slower speed, thus causing the problems. As soon as the surge of cotton is fed through, then the additional cotton is fed directly from the transition and elbow and the feed rollers do not impede the rate of flow of the cotton into the inclined feeder in any way. Stated otherwise, that the feed roller only impede the flow of the cotton into the inclined cleaner when there is a surge of cotton which would otherwise plug up or choke down the inclined feeder operation.

It will be understood that many variations of operations could be made. Although spiked feed rollers are preferred, it may be understood that other types of feeders could be used. The feed roller and the wad buster will have dispersing spikes 36 thereon. The rollers or wad buster perform as a means for moving the spikes along with the variable speed motor 32. It will be the spikes 36 which remove the seed cotton from the upright chamber 12 at a controlled rate.

The portion of the chamber 12 below the elbow 30 is considered the top 11 of the chamber and the portion above the feed rollers are considered the bottom 13 of the chamber. The chamber has a uniform cross-section between the top 11 and the bottom 13. That portion of the equipment which is below the bottom 13 of the chamber 12 is considered to be the dispersing unit 34. The portion of the equipment below the wad buster 40 is considered to be a outlet transfer means 42 which is for transferring the seed cotton. As seen the means 42 interconnects the dispersing unit to the seed cotton cleaner, also referred to as the inclined cleaner 10.

The suction 16 and transition 26 function as an inlet transfer means for transferring seed cotton into the chamber 12 by a blast of air in a conduit.

An additional advantage of this invention is that the cotton from the wad buster 40 in outlet transfer means 42 is spread evenly over the width of the inclined cleaner. This permits the inclined cleaner to operate at a higher rate than if the cotton is fed mainly along the center.

The storage hopper 12 with the separator comprising elbow 30 and by-pass 50, and also the dispersing unit 34 could operate A as a free standing unit. This free standing unit would be located after a module feeder and before the first seed cotton cleaner unit. The previously separated air blast would be reunited with the seed cotton at the free standing unit.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. The method of regularly feeding seed cotton into a seed cotton cleaner from an irregular flow of seed cotton carried in an air stream from a module feeder comprising:

a) separating the seed cotton from the air stream, then b) feeding the seed cotton into an upright chamber, then c) regularly feeding the cotton from the chamber, and then d) feeding the cotton into the seed cotton cleaner, and e) reuniting the air stream and the cotton after the cotton is fed from the chamber.

2. The method as defined in claim 1 wherein the seed cotton is fed into the cotton cleaner immediately after it is fed from the chamber.

3. The method as described in claim 1, further comprising:

f) flowing the separated air into the seed cotton cleaner.

4. A method of regularly feeding seed cotton into a seed cotton cleaner from an irregular flow of seed cotton carried in an air stream from a module feeder comprising:

a) separating the seed cotton from the air stream, then b) feeding the seed cotton into an upright chamber, then c) regularly feeding the cotton from the chamber, and then d) feeding the cotton into the seed cotton cleaner, wherein said separating step is by e) directing the seed cotton in the direction the air stream was traveling when carrying the cotton, and f) directing the air in a divergent direction from the direction the airstream was traveling when carrying the cotton.

5. The method as defined in claim 4 further comprising: after regularly feeding the cotton from the chamber, g) reuniting the cotton and air stream.

6. In a cotton gin having a) at least one seed cotton cleaner, and b) an airblast in a conduit for feeding seed cotton into said cotton gin, the improved structure in combination with the above comprising:

c) an upright chamber having a top and bottom, d) said chamber having a uniform cross-section from top to bottom, e) an inertia separator above the top of the upright chamber whereby cotton is transferred into the upright chamber and the air goes to a bypass conduit, f) a dispersing unit below the bottom of the upright chamber, g) dispersing spikes on at least one rotating drum in the dispersing unit, h) dispersing means for rotating the drum so arranged and constructed that seed cotton is removed from the chamber at a controlled rate, and i) outlet transfer means for transferring seed cotton interconnecting the dispersing unit to the seed cotton cleaners.

7. The structure as defined in claim 6 further comprising:

j) said dispersing unit mounted above the seed cotton cleaner.

k) the outlet transfer means is a short conduit, and l) said bypass conduit is connected into the top of said seed cleaner.

8. The structure as defined in claim 7 wherein m) said dispersing unit includes three drums mounted for rotation, n) said spikes are mounted on said drums, and o) at least one of said drums is a portion of means for break-ing up wads of seed cotton.

9. In a cotton gin having a) at least one seed cotton cleaner, the improved structure in combination with the above comprising:

b) a conduit containing seed cotton in an air blast connected to c) an inertia separator means for separating the air blast from the seed cotton and for directing the seed cotton into d) a connected upright chamber having a top and bottom, e) said chamber having a uniform cross-section from top to bottom, f) a dispersing unit connected below the bottom of the upright chamber, g) dispersing spikes in the dispersing unit, h) dispersing means for moving the spikes so arranged and constructed that seed cotton is removed from the chamber at a controlled rate, i) a outlet means for moving the seed cotton from the dispersing means into said seed cotton cleaner, and j) a by-pass air conduit connecting the inertia separator means and the top of the seed cotton cleaner.

* * * * *